US006390870B1

(12) United States Patent
Hughes et al.

(10) Patent No.: US 6,390,870 B1
(45) Date of Patent: May 21, 2002

(54) MARINE ENGINE COOLING SYSTEM WITH SIMPLIFIED WATER DRAIN AND FLUSHING MECHANISM

(75) Inventors: William E. Hughes, Perry; Matthew W. Jaeger; Charles E. Wright, both of Stillwater, all of OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/797,142

(22) Filed: Mar. 1, 2001

(51) Int. Cl.[7] ..... E01P 11/02
(52) U.S. Cl. ..... 440/88; 123/41.14
(58) Field of Search ..... 440/88; 123/41.14

(56) References Cited

U.S. PATENT DOCUMENTS 5,980,342 A 11/1999 Logan et al. ..... 440/88
6,089,934 A 7/2000 Biggs et al. ..... 440/88
6,135,064 A 10/2000 Logan et al. ..... 123/41

*Primary Examiner*—Sherman Basinger
(74) *Attorney, Agent, or Firm*—William D. Lanyi

(57) ABSTRACT

A draining system for a marine propulsion engine is provided in which a manifold is located at a low portion of the cooling system to allow all of the water within the cooling system to drain through a common location, or manifold. A rigid shaft is connected to a valve associated with the manifold and extended upwardly from the manifold to a location proximate the upper portion of the engine so that a marine vessel operator can easily reach the upper end of the shaft and manipulate the shaft to open the valve of the manifold. In this way, the valve can be opened to allow all of the water to drain from the engine without requiring the marine vessel operator to reach toward locations at the bottom portion of the engine.

5 Claims, 3 Drawing Sheets

MARINE ENGINE COOLING SYSTEM WITH SIMPLIFIED WATER DRAIN AND FLUSHING MECHANISM

BACKGROUND OF THE INVENTION

1. Field of the Invention

The present invention is generally related to an engine drain and flushing system and, more particularly, to an engine drain system that allows easy access to a handle which permits the operator of a marine vessel to open and close the drain, which is located near the bottom of the engine, without having to directly manipulate the drain manually to accomplish these purposes.

2. Description of the Prior Art

Many different types of engine drain systems are known to those skilled in the art. For example, U.S. Pat. No. 6,135,064, which issued to Logan et al on Oct. 24, 2000 discloses an engine drain system. The engine cooling system is provided with a manifold that is located below the lowest point of the cooling system of an engine. The manifold is connected to the cooling system of the engine, a water pump, a circulation pump, the exhaust manifolds of the engine, and a drain conduit through which all of the water can be drained from the engine.

U.S. Pat. No. 5,980,342, which issued to Logan et al on Nov. 9, 1999, discloses a flushing system for a marine propulsion engine. The flushing system provides a pair of check valves that are used in combination with each other. One of the check valves is attached to a hose located between the circulating pump and the thermostat housing of the engine. The other check valves is attached to a hose through which fresh water is provided. Both check valves prevent flow of water through them unless they are associated together in locking attachment. The check valve attached to the circulating pump hose of the engine directs a stream of water from the hose toward the circulating pump so that the water can then flow through the circulating pump, the engine block, the heads, the intake manifold, and the exhaust system of the engine to remove sea water residue from the internal passages and surfaces of the engine. It is not required that the engine be operated during the flushing operation.

U.S. Pat. No. 6,343,965 which issued to Biggs et al on Feb. 5, 2002, discloses a drain system for a marine vessel which is pneumatically actuated. The drain system includes one or more pressure actuated valves associated with the coolant water drain system. The boat operator is provided with a pressure controller that allows pressure to be introduced into the system for the purpose of actuating the drain valve and, as a result, opening various drain conduits to allow cooling water to drain from the engine cooling system into the bilge or overboard.

U.S. Pat. No. 6,089,934, which issued to Biggs et al on Jul. 18, 2000, discloses an engine cooling system with a simplified drain and flushing procedure. The engine cooling system is provided with one or more flexible conduits attached to drain openings of the engine and its related components. First ends of the conduits are attached to the drain openings while the second ends are sealed by studs attached to a plate of a stationary bracket. A retainer is slidably associated with the flexible conduits and attached to a tether which is, in turn, attached to a handle. By manipulating the handle, the tether forces the retainer to slide along the flexible conduits and control the position of the second ends of the flexible conduits. This allows the system to be moved from a first position with the second ends of the conduits above the first ends of the conduits to a second position with the second ends of the conduits below the first ends and in the bilge of the boat. This allows an operator to stand in a single location and move the drain system from the first and second positions and back again without having to reach down into the engine compartment to remove drain plugs. The system allows the cooling system to be easily drained and flushed.

U.S. patent application Ser. No. 09/716,533 which was filed on Nov. 20, 2000 by Biggs et al and assigned to the assignee of the present application discloses a marine engine cooling system which is provided with a valve in which a ball moves freely within a cavity formed within the valve. Pressurized water, from a water pump, causes the ball to block fluid flow through the cavity and forces pumped water to flow through a preferred conduit which may include a heat exchanger. When the water pump is inoperative, the ball moves downward within the cavity to unblock a drain passage and allow water to drain from the heat generating components of the engine.

The patents described above are hereby expressly incorporated by reference in the description of the present invention.

In certain types of marine propulsion systems, it would be significantly beneficial if a simple mechanism could be provided to allow the operator of a marine vessel to actuate the drain valve without having to physically manipulate the lower portions of the engine or its cooling system.

SUMMARY OF THE INVENTION

An engine drain system made in accordance with the present invention comprises an engine having a water cooling system which, in turn, comprises internal passages within a block of the engine. It also comprises a manifold having internal passages and connected in fluid communication with the water cooling system. A drain system is connected in fluid communication with a manifold, whereby the water cooling system can be effectively drained through the drain conduit by the effect of gravity. A valve is associated with a drain conduit for selectively blocking or unblocking the drain conduit. A manually movable actuator is attached to the valve and comprises a shaft having a first end and a second end. The shaft extends upward from the valve to a location proximate, or at the height of, a top portion of the engine. The shaft is movable into a first position to cause the valve to block the drain conduit and into a second position to cause the valve to unblock the drain conduit.

The second, or lower, end of the shaft is attached to the valve and the first, or upper, end of the shaft is attached to a manually rotatable handle. The manifold is disposed below the level of the lowest portion of the water cooling system which normally retains cooling water when the engine is not operating, in a particularly preferred embodiment of the present invention.

The shaft extends in a generally vertical direction upward from the valve in one embodiment of the present invention in order to locate the handle, at the first end of the shaft, at a reasonably convenient location for manual access by the operator of the marine vessel. The shaft is axially movable between the first and second positions of the valve in response to rotation of the shaft about an axis of the shaft, in a particularly preferred embodiment of the present invention. Alternatively, the shaft can be axially movable in response to the operation of a manual lever by the operator of the vessel.

BRIEF DESCRIPTION OF THE DRAWINGS

The present invention will be more fully and clearly understood from a reading of the description of the preferred embodiment of the present invention, in conjunction with the drawings, in which.

DESCRIPTION OF THE PREFERRED EMBODIMENT

Figure 1:
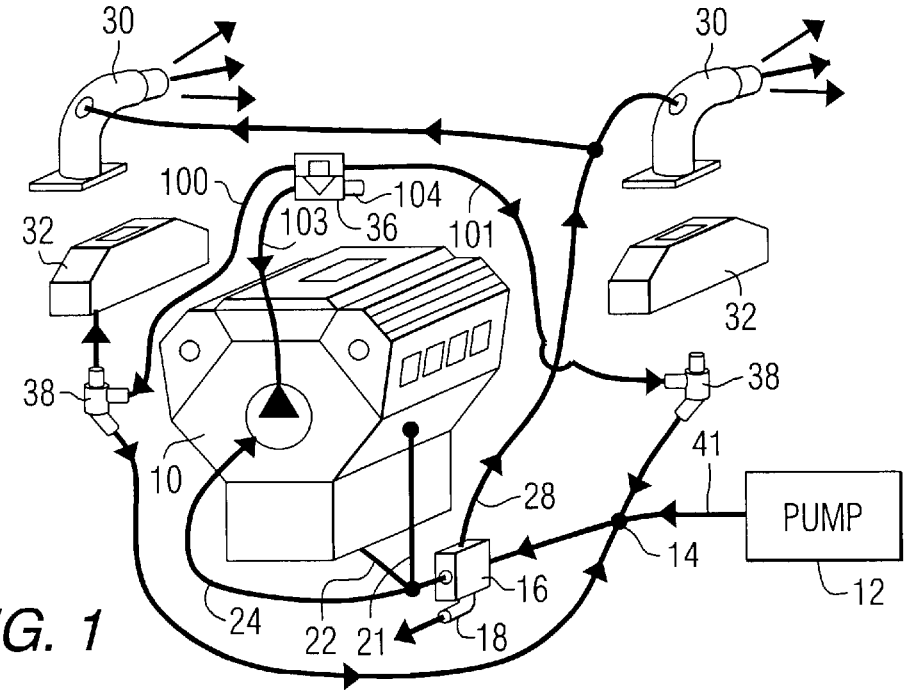
FIG. 1 is a highly schematic representation of the cooling and flushing system of a marine engine.

Throughout the description of the preferred embodiment of the present invention, like components will be identified by like reference numerals.

FIG. 1 is a highly schematic representation of a marine propulsion system which shows the basic fluid flow paths of the cooling system of an engine 10. Water flows initially from a water pump 12 in the drive unit (not shown) of a stern drive marine propulsion system. The water flows through a connection point 14 to a manifold 16. From the manifold 16, a drain conduit 18 is provided to allow water to flow out of the cooling system of the engine 10 when the cooling system is drained, as will be described in greater detail below. Two drain lines, 21 and 22, connect the internal cooling passages of the engine block to the manifold 16. Water flowing through the manifold 16, under the influence of the water pump 12 during normal operation of the engine, passes into the block of the engine 10, as represented by arrow 24. Some of the water flowing through the manifold 16, under the influence of the pump 12, passes through a bypass line 28 to the exhaust elbows 30.

The rate of water flow to either the engine (i.e. conduit 24) or the bypass (i.e. conduit 28) is controlled by a fixed orifice in manifold 16. When the engine is operating, line 103 allows cooling water in the engine to recirculate until the thermostat within the thermostat housing 36 opens in response to the cooling water temperature rising to a preselected threshold magnitude. Once the thermostat has opened, some hot water passes overboard through conduits 100 and 101 and some hot water continues to recirculate. The hot water that leaves the system is replaced by cold water from pump 12. The thermostat controls how much hot water leaves the system and is replaced. This, in effect, controls the engine operating temperature.

With the engine turned off, the cooling system may be flushed by introducing fresh water into the cooling system in a generally reverse direction to normal water flow. Flush water is introduced into the thermostat housing 36 through a connector 104 and flows, as represented by the arrows extending from the thermostat housing 36, through the engine and the various conduits, and eventually overboard.

Figure 2:
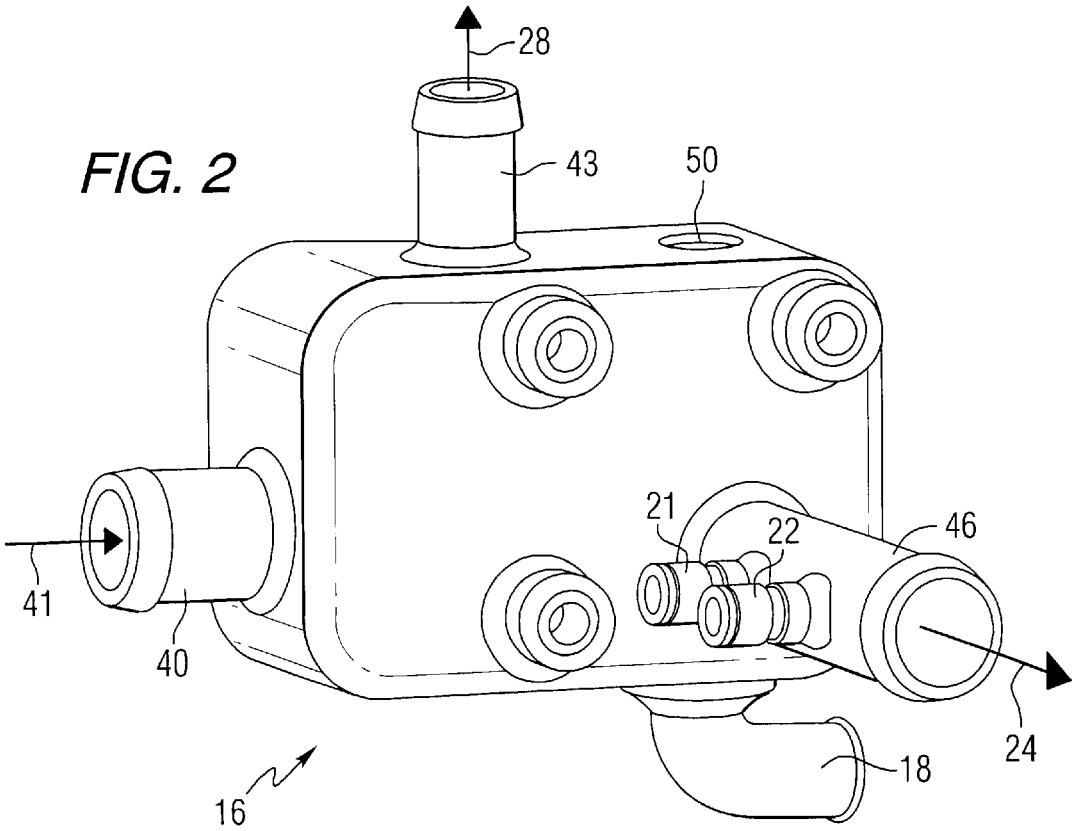
FIG. 2 is an isometric view of a manifold used in conjunction with the present invention.

FIG. 2 is an isometric view of the manifold 16. Water flows into the manifold 16, from the water pump 12, through conduit 40, as represented by directional arrow 41. Some of the water flowing into the manifold 16 is caused to flow through conduit 43, as a bypass flow, toward the exhaust elbows 30, as represented by directional arrow 28. Another conduit 46, provides the main water flow to the engine, as represented by directional arrow 24. It can be seen that two conduits connect into conduit 46 and provide the connections for the engine drainage flow as described above in conjunction with FIG. 1. A drain conduit 18 is located at the bottom portion of the manifold 16.

With continued reference to FIG. 2, it can be seen that an opening 50 is provided in the top portion of the manifold 16 and generally aligned with the connection between the manifold 16 and the drain conduit 18. In other words, opening 50 is above the connection between the drain conduit 18 and the manifold 16.

Figure 3A:
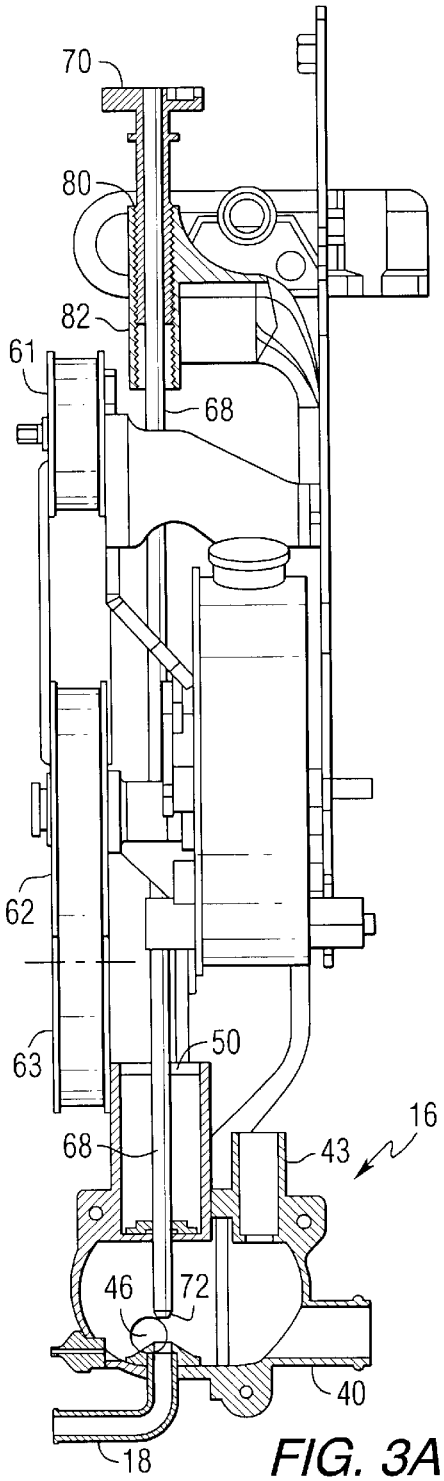
FIGS. 3A and 3B show partially sectioned views of the present invention with the valve unblocked and blocked, respectively.
Figure 3B:
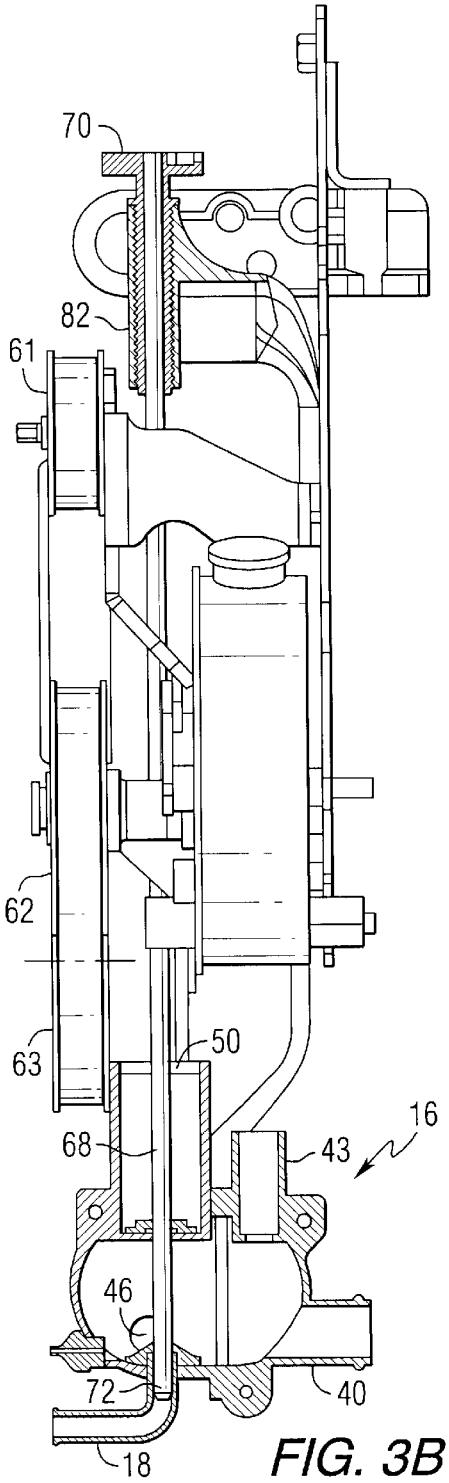

FIGS. 3A and 3B show the present invention associated with certain components of an engine 10 described above. The various pulleys, 61–63, are located at the front portion of the engine. In FIGS. 3A and 3B, the entire engine is not shown for purposes of simplicity. The manifold 16 is shown with its bypass conduit 43, its water inlet conduit 40, its water outlet conduit 46, and its drain conduit 18. Extending downward through opening 50 is a shaft 68. The shaft extends upward, as shown in FIG. 3A, to a location proximate the top portion of the engine where it is attached to a manually rotatable handle 70. Although not specifically illustrated in FIGS. 3A and 3B, a preferred embodiment of the present invention uses a shaft 68 that is a hollow tube. A second end 72 of the shaft 68, located at the bottom of the shaft 68, acts as a valve in combination with the drain conduit 18. In the position shown in FIG. 3A, the second end 72 of the shaft 68 is moved to a position out of the drain conduit 18. This position defines an unblocked status of the valve relative to the drain conduit 18. When the shaft 68 is in the position shown in FIG. 3A, water can flow freely from the cavity within the manifold 16 and through the drain conduit 18 to the bilge of a marine vessel, or alternatively, overboard. Since the manifold 16 is connected in fluid communication with all of the portions of the cooling system of the engine 10, as described above in conjunction with FIG. 1, all of that water can flow into the cavity of the manifold 16 and, when the valve is unblocked, out of the drain conduit 18. This allows the movement of the shaft 68 to cause all of the water to flow out of the engine cooling system and into the bilge, or overboard, through the drain conduit 18.

With continued reference to FIG. 3A, the upper portion of the shaft 68, just below the handle 70, is threaded as represented by reference numeral 80. These threads are shaped to mesh with internal threads of tube 82 which is fixed to the engine structure. By rotating the handle 70 and the attached shaft 68, the shaft 68 can be caused to move axially downward in response to the interaction between the threads 80 and the internal threads of the tube 82. This moves the second end 72 of the shaft 68 downward through the cavity of the manifold 16 and into the opening at the upper portion of the drain conduit 18.

FIG. 3B shows the shaft 68 with its second end 72 disposed in the upper opening of the drain conduit 18. The handle 70 is located at a position lower than that shown in FIG. 3A because the threads 80 at the upper portion of the shaft 68 have caused the shaft 68 to move downward axially to place the second end 72 into the upper opening of the drain conduit 18. This blocks the drain conduit 18 and prevents water from draining from the manifold 16 and through the drain conduit 18.

With reference to FIGS. 3A and 3B, it can be seen that the operator of a marine vessel can drain the cooling system of the engine by simply rotating handle 70 to unblock the drain conduit 18 as shown in FIG. 3A. By rotating the handle 70 back to its blocking position, the second end 72 can be moved downward into the upper opening of the drain conduit 18 as shown in FIG. 3B. Unlike many known types of marine propulsion systems, the present invention alleviates the need for the operator to actually reach down and manually manipulate components of the manifold 16 or other drain plugs in order to drain the engine. In some known systems, the draining procedure requires the marine vessel operator to physically reach down or crawl down into the bilge to remove drain plugs. This is a cumbersome effort and was subject to error, in which the operator could possibly fail to remove one or more drain plugs and, as a result, ineffectively drain the engine. On the other hand, the present invention places the handle 70 at the upper portion of the engine 10 in order to allow the operator to drain the cooling system without having to reach down toward the bottom portion of the engine. In a particularly preferred embodiment of the present invention, the handle 70 is blue in color. This indicates a water service point according to an international color coding scheme. The portion near the threads 80 is red in color in a preferred embodiment of the present invention so that the opened valve can be easily recognized by the appearance of the red portion 80. If the operator is able to see the red portion 80, it will be recognized that the device is opened.

Figure 4:
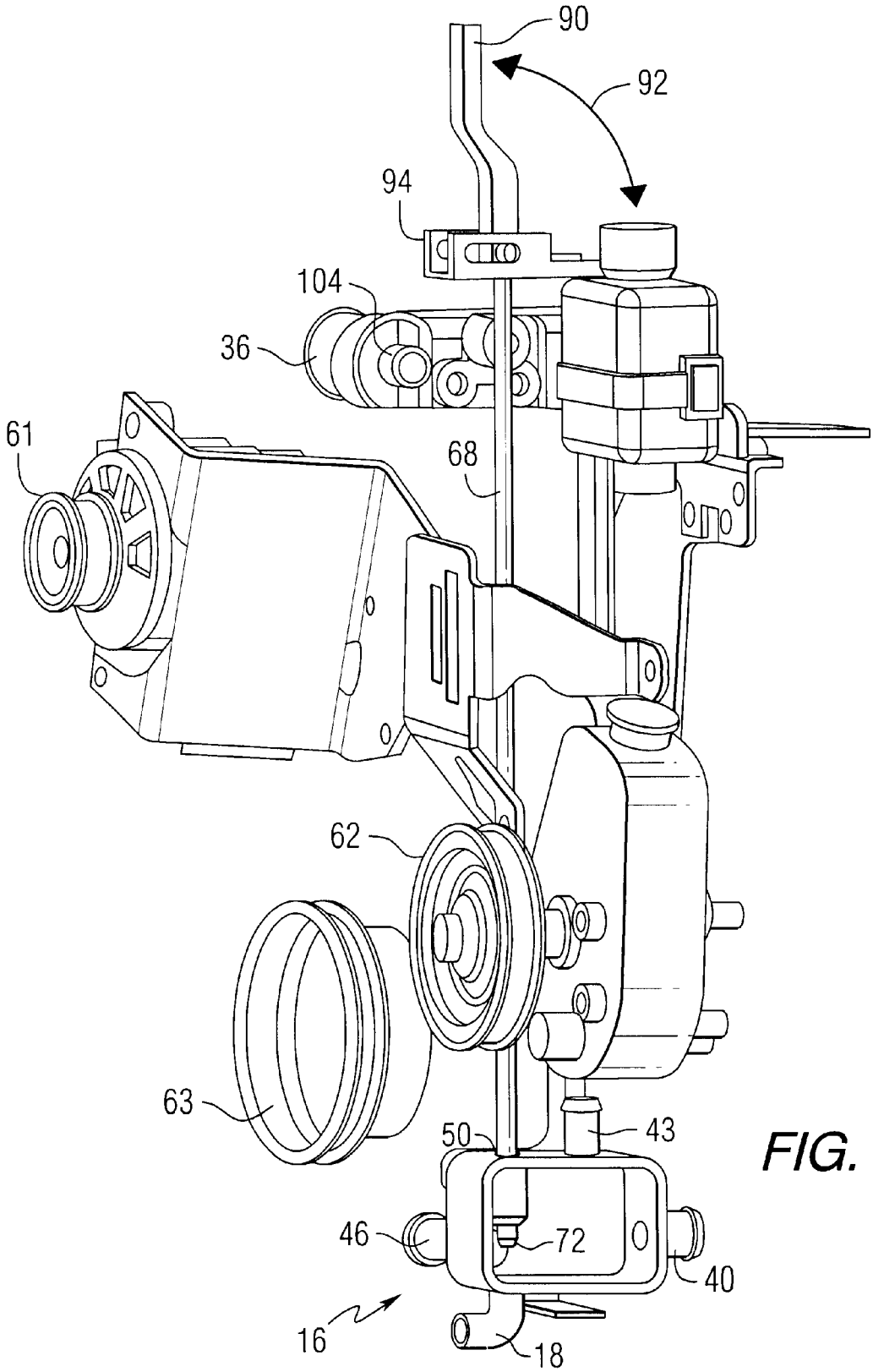
FIG. 4 shows an alternative embodiment of the present invention.

FIG. 4 shows a slightly different structure that implements an alternative embodiment of the present invention. The shaft 68 moves axially upward or downward to unblock or block, respectively, the upper opening drain conduit 18 at the bottom of the manifold 16. This axial movement of the shaft 68 causes it to move upward or downward through opening 50 to block or unblock the upper opening the drain conduit 18. However, it can be seen that the first end of the shaft 68, at its upper position, is not attached to a handle 70 as described above in conjunction with FIGS. 3A and 3B. Instead, a lever 90 is movable from a first position shown in FIG. 4A to a second position which is 90° displaced from the position shown. When in the position shown in FIG. 4A, the handle 90 places the shaft 68 in an upward axial position to unblock the drain conduit 18. When moved downward, as represented by directional arrow 92, to a position generally horizontal and parallel to its bracket 94, the shaft 68 moves downward so that its second end 72 blocks the upper opening of the drain conduit 18.

With continued reference to FIG. 4, the system is also provided with a thermostat housing 36 which includes a connector 104 that allows a water hose to be attached to it. Although not shown in FIG. 4, hoses would extend from the thermostat housing 36 to various locations of the cooling system, as described above in conjunction with FIG. 1. Fresh water can be pumped into the thermostat housing 36 through a connector 104 for the purpose of flushing the cooling system. A conduit extends from the thermostat housing 36, the circulation pump on the engine, and also to each exhaust manifold.

The main advantages of the present invention include its simplicity and inexpensive implementation. The present invention requires few components and can be used to drain the cooling water from the engine in a very short period of time. It is easily accessible by the operator of the marine vessel without having to employ the services of a professional service shop. By providing a simple shaft 68 in conjunction with the manifold 16, a handle 70 or lever 90 can be provided at the upper end of the shaft 68 to allow an operator to conveniently reach and manipulate the handle or lever. This, in turn, allows the operator of a marine vessel to easily unblock the opening in the manifold 16 to allow all of the water to drain from the engine and its associated cooling system. By placing the manifold 16 at a position below the cooling system of the engine, as described in detail in U.S. Pat. No. 6,135,064, in conjunction with the simple but positive shaft actuation means and conveniently located handle 70, the present invention provides an inexpensive and robust draining system that avoids the need for a marine vessel operator to reach to a position at the lower portion of the engine for the purpose of removing drain plugs. Although the present invention has been described to illustrate a particularly beneficial embodiment, it should be understood that alternative embodiments are also within its scope.

We claim:

1. An engine drain system for a marine propulsion system; comprising:

an engine having a water cooling system, said water cooling system comprising internal passages within an engine block of said engine;

a manifold having internal passages and connected in fluid communication with said water cooling system;

a water pump, having an inlet and an outlet, for drawing water from a body of water and causing said water to flow into said manifold, said outlet of said pump being connected in fluid communication with said internal passages of said manifold;

a drain conduit connected in fluid communication with said manifold, whereby said water cooling system can be effectively drained through said drain conduit under the effect of gravity;

a valve associated with said drain conduit for selectively blocking or unblocking said drain conduit; and a manually movable actuator attached to said valve, said manually movable actuator comprising a shaft having a first end and a second end, said shaft extending upward from said valve to a location proximate a top portion of said engine, said shaft being movable, in a direction parallel to a central axis of said shaft, into a first position to cause said valve to block said drain conduit and into a second position to cause said valve to unblock said drain conduits said shaft being movable toward an opening of said drain conduit to block said drain conduit and away from said opening of said drain conduit to unblock said drain conduit.

2. The system of claim 1, wherein:

said second end of said shaft is attached to said valve.

3. The drain system of claim 1, wherein:

said first end of said shaft is attached to a manually rotatable handle.

4. The system of claim 1, wherein:

said manifold is disposed below the level of the lowest portion of said water cooling system which normally retains cooling water when said engine is not operating.

5. The system of claim 1, wherein:

said shaft extends in a generally vertical direction upward from said valve.

* * * * *